US005926098A

United States Patent [19]

Wiemeyer et al.

[11] Patent Number: 5,926,098

[45] Date of Patent: Jul. 20, 1999

[54] ASPIRATED DETECTOR

[75] Inventors: Jim Wiemeyer, Homer Townership; Thomas William Shoaff, Warrenville; George Schoenfelder, Batavia; Lee Tice, Bartlett, all of Ill.

[73] Assignee: Pittway Corporation, Chicago, Ill.

[21] Appl. No.: 08/740,203

[22] Filed: Oct. 24, 1996

[51] Int. Cl.[6] ..... G08B 17/10

[52] U.S. Cl. ..... 340/630; 340/578; 340/584; 340/628; 340/691.1; 340/693.6; 250/573; 356/438

[58] Field of Search ..... 340/577–579, 340/584, 627–630, 632, 691.1, 693.6; 250/381, 573; 356/438; 116/214; 454/234, 237, 257

[56] References Cited

U.S. PATENT DOCUMENTS

| | | | |
|---|---|---|---|
| 3,028,490 | 4/1962 | Guilleux | 250/393 |
| 3,765,842 | 10/1973 | Purt | 340/633 |
| 3,884,304 | 5/1975 | Messerschmidt et al. | 340/628 |
| 3,952,808 | 4/1976 | Richardson | 340/628 |
| 4,035,788 | 7/1977 | Barr | 340/627 |
| 4,099,065 | 7/1978 | Malinowski | 250/574 |
| 4,254,414 | 3/1981 | Street et al. | 340/628 |
| 4,543,815 | 10/1985 | Troup et al. | 340/628 |
| 4,608,556 | 8/1986 | Cole | 340/628 |
| 4,617,560 | 10/1986 | Gutmann | 340/628 |
| 4,665,311 | 5/1987 | Cole | 340/630 |
| 4,785,288 | 11/1988 | Heberlein, Jr. et al. | 340/628 |
| 4,868,546 | 9/1989 | Dumbeck | 340/632 |
| 5,231,378 | 7/1993 | Dennis et al. | 340/630 |
| 5,372,477 | 12/1994 | Cole | 415/218.1 |
| 5,392,114 | 2/1995 | Cole | 340/630 |
| 5,410,299 | 4/1995 | Hard | 340/628 |
| 5,486,811 | 1/1996 | Wehrle et al. | 340/628 |
| 5,552,775 | 9/1996 | Harley | 340/628 |
| 5,625,346 | 4/1997 | Shim et al. | 340/628 |

FOREIGN PATENT DOCUMENTS

| | | |
|---|---|---|
| 0324295 | 7/1989 | European Pat. Off. . |
| 0638885 | 2/1995 | European Pat. Off. . |
| 954578 | 4/1964 | United Kingdom . |
| 2277625 | 11/1994 | United Kingdom . |
| WO 9607166A1 | 3/1996 | WIPO . |

OTHER PUBLICATIONS

VESDA ® E70–D, "Programmable, Microprocessor Controlled, Self–Contained, Air Sampling Smoke Detector", 4 pages, printed Apr., 1995.

VESDA ® Vesda Scanner™ Individual Pipe Innunciating, Programmable, Microprocessor Controlled, Self–Contained, Air Sampling Smoke Detector, 4 pages, printed Apr., 1995.

VESDA ® "Computer Facility Fire Detection", 23 pages, printed May, 1995.

Cole, Martin Application of Electronics—Sensor Developments, 16 pages, printed May, 1994.

FENWAL® "AnaLASER™ HSSD®–LTT", 6 pages, copyright 1992.

Stratos™ "HSSD® High Sensitivity Smoke Detector, Installers handbook", 30 pages, copyright 1993.

*Primary Examiner*—Daniel J. Wu

*Attorney, Agent, or Firm*—Rockey, Milnamow & Katz Ltd.

[57] ABSTRACT

An aspirated-type detector includes a housing with an internal ambient condition sensing region and a sensor carried therein. The housing is perforated with ambient atmosphere inflow ports. A fan or similar device lowers the pressure in the internal region thereby producing a positive inflow of adjacent, external ambient atmosphere into the sensing region. Alternatively, the fan can be operated to inject exterior ambient atmosphere into the sensing chamber under positive pressure. The fan can also be modularized. The detector can incorporate control circuitry for supervisory or signal processing purposes.

6 Claims, 8 Drawing Sheets

FIG. 1 ASPIRATED PHOTO (LASER) DETECTOR

ASPIRATED ION DETECTOR 50
54
10'
52
HOLE DRILLED FOR AIR FLOW
56
48
46
SMOKE SENSING CHAMBER COVER
100PPI FOAM FILTERS
44
42c
42b
AMERECIUM SOURCE
42d
42
PCB
42a
14'
20'
12'

FIG. 3 EXTERNAL AIR FLOW

FIG. 4 INTERNAL AIR FLOW - CHAMBER UNDER VACUUM

FIG. 5 INTERNAL AIR FLOW - CHAMBER UNDER PRESSURE

INTERNAL AIR FLOW - CHAMBER UNDER VACUUM (AT END OF SEPTUM)
80'
INTAKE (360°)
INTAKE (360°)
88'
83'
82'
LASER BEAM
82b'
FAN VACUUM PORT (AT SEPTUM)
26
24 PHOTO-DIODE
28'
PCB
14"
VACUUM (INTERNAL OPTION)
82a
GASKET
84a
84
FILTER
84b
84b
12

ASPIRATED DETECTOR

FIELD OF THE INVENTION

The invention pertains to ambient condition detectors. More particularly, the invention pertains to detectors which incorporate a fan or similar device to draw or force exterior ambient atmosphere into the detector.

BACKGROUND OF THE INVENTION

Ambient condition detectors have been found to be useful in providing an indication of the presence of the respective condition. Smoke detectors have been found useful in providing early warnings of the presence of airborne particulate matter such as smoke.

Known smoke detectors often include a housing with an internal smoke chamber. Either an ionization-type or a photoelectric-type smoke sensor can be located in the housing.

Vents are located in the housing. Ambient air circulates into and out of the housing in response to movement of the adjacent atmosphere.

Air circulation in a region being monitored does bring the airborne particulate matter into the housing. Depending on the nature of the air currents, this can be a faster or a slower process.

In large commercial buildings air circulation is often achieved by centralized heating and cooling systems. Building control systems alter air flow in response to preset schedules. Hence, there may be times of minimal or no circulation such as evenings or weekends. There continues to be a need for solutions to these minimal or no circulation situations.

SUMMARY OF THE INVENTION

In accordance with the invention, an ambient condition detector includes a housing with an internal sensing region. The housing has one or more apertures to permit the ingress and egress of external ambient atmosphere into and out of the sensing region.

An ambient condition sensor is located in the region. A source for creating positive or negative pressure in the internal region can, for example, be carried by the housing.

In one aspect of the invention, the source could be a fan or similar device arranged to exhaust the atmosphere of the internal region thereby creating a negative pressure and a positive inflow of ambient exterior atmosphere into the internal region. The source could also be implemented as a solid state mover of ambient atmosphere.

In a further aspect of the invention, the source can be arranged to inject exterior ambient atmosphere into the sensing region under positive pressure.

In yet another aspect of the invention the sensor can incorporate an ionization or a photo-electric-type smoke sensor. Alternatively, a sensor of a selected gas such as CO or propane can be incorporated into the housing.

Further, the source of positive or negative pressure can be configured as a separate module. This module can removably engage the housing. The module can inject ambient atmosphere into the housing via one or more input ports.

The source could be a centrifugal fan. Ambient atmosphere can be drawn into or expelled from the housing around a 360° circular perimeter. Alternately, the ambient atmosphere can be drawn into the housing through a plurality of collecting tubes that emanate from the housing.

A control unit can be incorporated to control the speed or on-off cycling of the source. The control unit could also process signals from the sensor to determine, for example, if the output signals indicate the presence of an alarm condition. Alternately, the sensor output signals could be compared to high and low maintenance threshold values.

In yet another aspect of the invention, an aspirated photoelectric detector can include a septum. Either an atmospheric input port or an output port can be located at an end of the septum.

Numerous other advantages and features of the present invention will become readily apparent from the following detailed description of the invention and the embodiments thereof, from the claims and from the accompanying drawings.

DETAILED DESCRIPTION OF THE DRAWINGS

Figure 1:
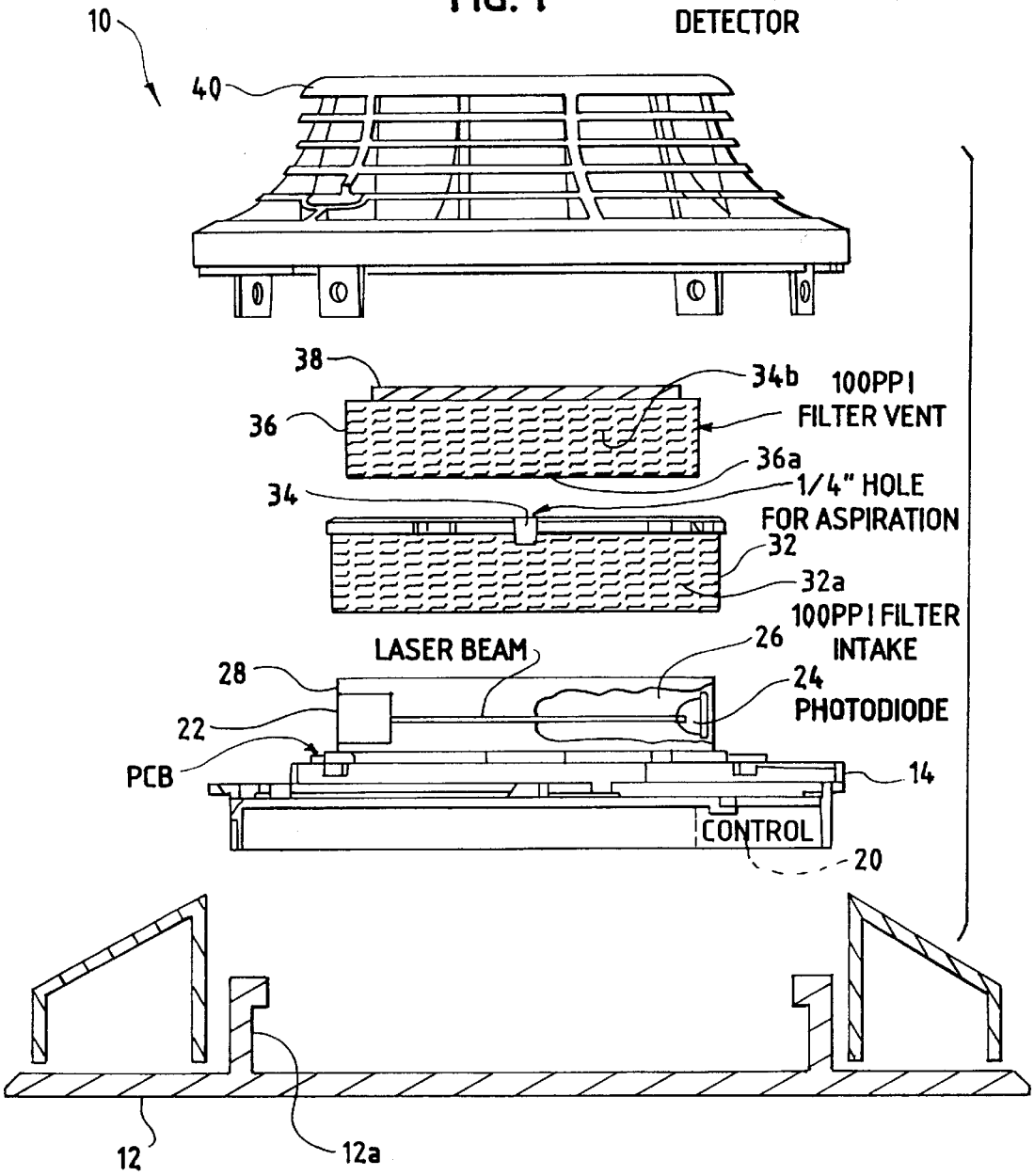
FIG. 1 is an exploded view, partly in section, of a photoelectric detector in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates an aspirated photoelectric detector 10 in accordance with the present invention. The detector 10 incorporates a base 12 (although alternately, the detector could be mounted without the use of a base).

When used with the base 12, a cylindrical bottom portion 14 is removably lockable to the base 12. In this embodiment, the base 12 would be mounted on a wall or ceiling. The lockable bottom member 14 removably engages the base 12 by means of a twist-lock mechanism 12*a*.

The detector bottom element 14 carries an electronic control element 20 (illustrated in phantom), a source of radiant energy 22 which could be, for example, a laser diode, a sensor 24 spaced from the source 22, and an optional reflector 26. The source 22, sensor 24 and reflector 26 are carried by an upper cylindrical element which forms a sensing region 28.

A cylindrical filter 32 slides over the element 28 and, in cooperation therewith, forms a sensing chamber which surrounds the source 22 and the detector 24. The filter 32 could be implemented as a metal, plastic or fibrous screen with intake openings 32*a*. It could also be formed of a porus plastic. The filter 32 is intended to exclude bugs, airborne fibers, dust, steam and water mist. The filter 32 has a centrally located opening 34, described further subsequently.

Carried on the top of the filter 32 is a centrifugal blower or fan 36. The fan 36 could be, for example, a Nidec Model γ26 centrifugal blower which has been modified by removing the exterior housing thereof. In this configuration, the fan 36 can be operated to draw ambient atmosphere into the blower via a centrally located input port 36*a* and expel that ambient atmosphere under positive pressure about a 360° circumference from output ports 36*b*.

The sensing region 28 is subjected to a negative pressure when opening 34 is coupled to input port 36*a*. This in turn causes ambient atmosphere to flow into the sensing region through the filter 32, out the central port 34 into the fan 36 and then ambient atmosphere is expelled via the ports 36*b* around the 360° circumference of the fan 34.

When the fan 36 is operated to produce a negative pressure in the sensing chamber, the filter element 32 filters the incoming ambient atmosphere, which enters the sensing chamber on a 360° circumference around that chamber. An air flow monitor 38 can be carried on the fan 36.

The detector 10 can in turn be enclosed by a decorative cover 40.

It will be understood that the control unit 20 could be used to control operation of the fan 36 in either a continuous or intermittent mode. The control unit 20 could be used to reverse direction of operation of the fan 36 as well as to carry out processing of the signals from the sensor 24 as well as the monitor 38.

Typical types of signal processing contemplated by the control unit 20 include determining whether the signals from the sensor 24 fall within upper and lower predetermined normal operating or maintenance limits, as well as whether the output signals from the detector 24 are indicative of an alarm condition.

In addition, the level of air flow can be sensed via monitor 38 and signals indicative thereof can be provided for local or remote use. Fan speed can also be adjusted in response to the flow rate.

Figure 2:
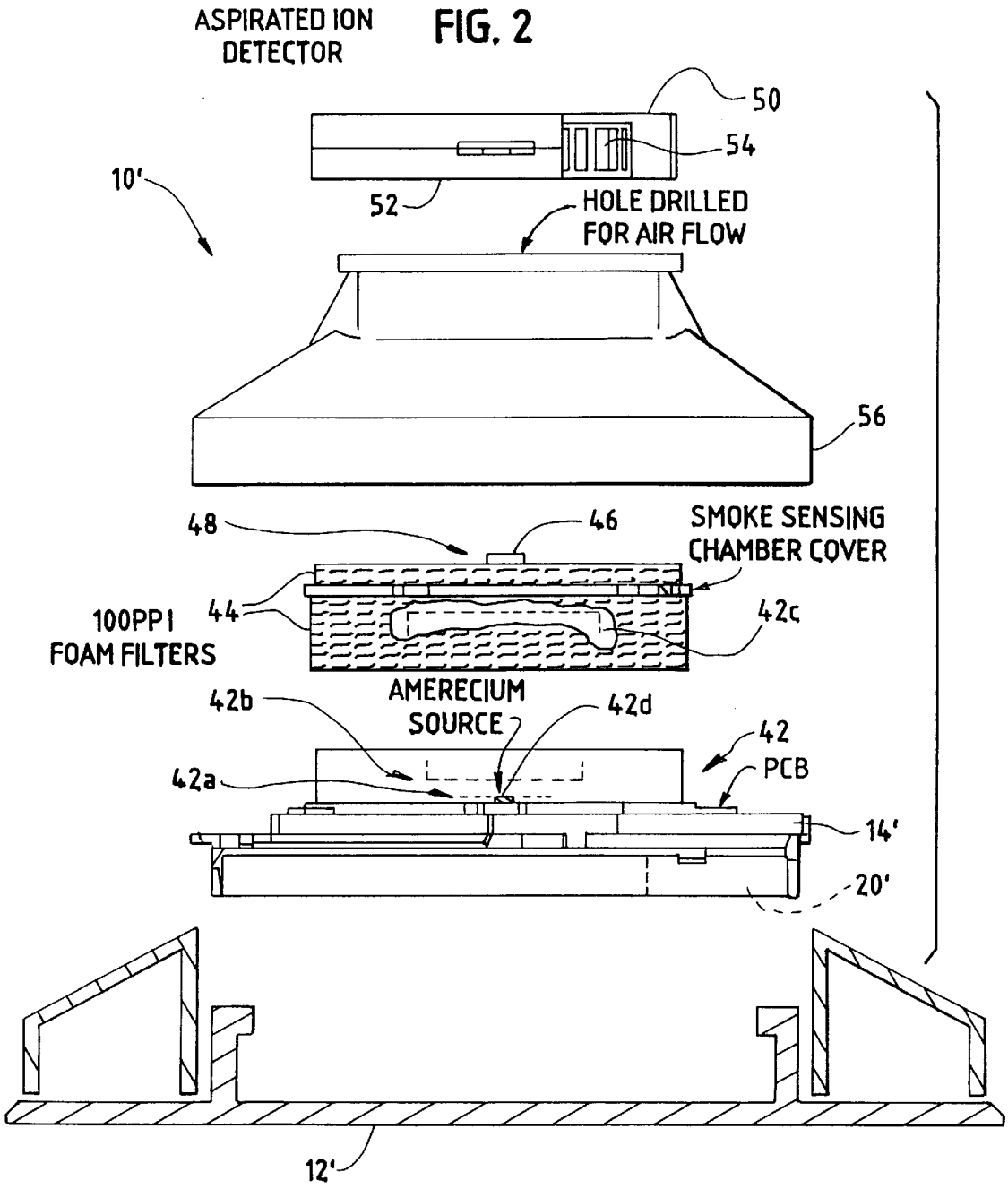
FIG. 2 is an exploded view, partly in section, of an ionization type detector in accordance with the present invention.

FIG. 2 illustrates an aspirated ionization-type detector 10'. The detector 10' can include a mounting base 12' (although as noted above, the mounting base 12' is not required). The detector 10' includes a bottom element 14' which carries a control element 20' (indicated in phantom), as well as an ionization-type sensor 42 which incorporates an inner electrode 42*a*, a center or sensing electrode 42*b* and an outer electrode 42*c*, along with a source of ionization 42*d*.

A cylindrical foam filter element 44 peripherally surrounds the ionization-type sensor, noted above, and serves to keep bugs, dust, steam, water mist and other undesirable particulate matter out of the sensor. The filter 44 carries a centrally located upper airflow output port 46. An airflow monitor 48 could be positioned adjacent to the airflow port 46.

Flow of ambient atmosphere in the detector 10' is established by means of centrifugal blower 50. The blower 50 could be, for example, a Nidec Model γ26 blower which contains a centrally located input port 52 and an output port 54.

The blower 50 is illustrated in FIG. 2 mounted on the top of cover 56 for the detector 10'. It will be understood that the blower 50 could be incorporated within the cover 56 without departing from the spirit and scope of the present invention.

The input port 52 of the blower 50 is coupled to the output port 46 of the filter clement 44. With this arrangement, blower 50 can be used to create a negative pressure within the ionization sensor 42 causing a circumferential flow of ambient atmosphere through the filter 44 into the chamber 42, out the port 46, into the port 52, and then out through the exit port 54.

The control unit 20' can provide similar functions as described above with respect to the control unit 20.

Figure 3:
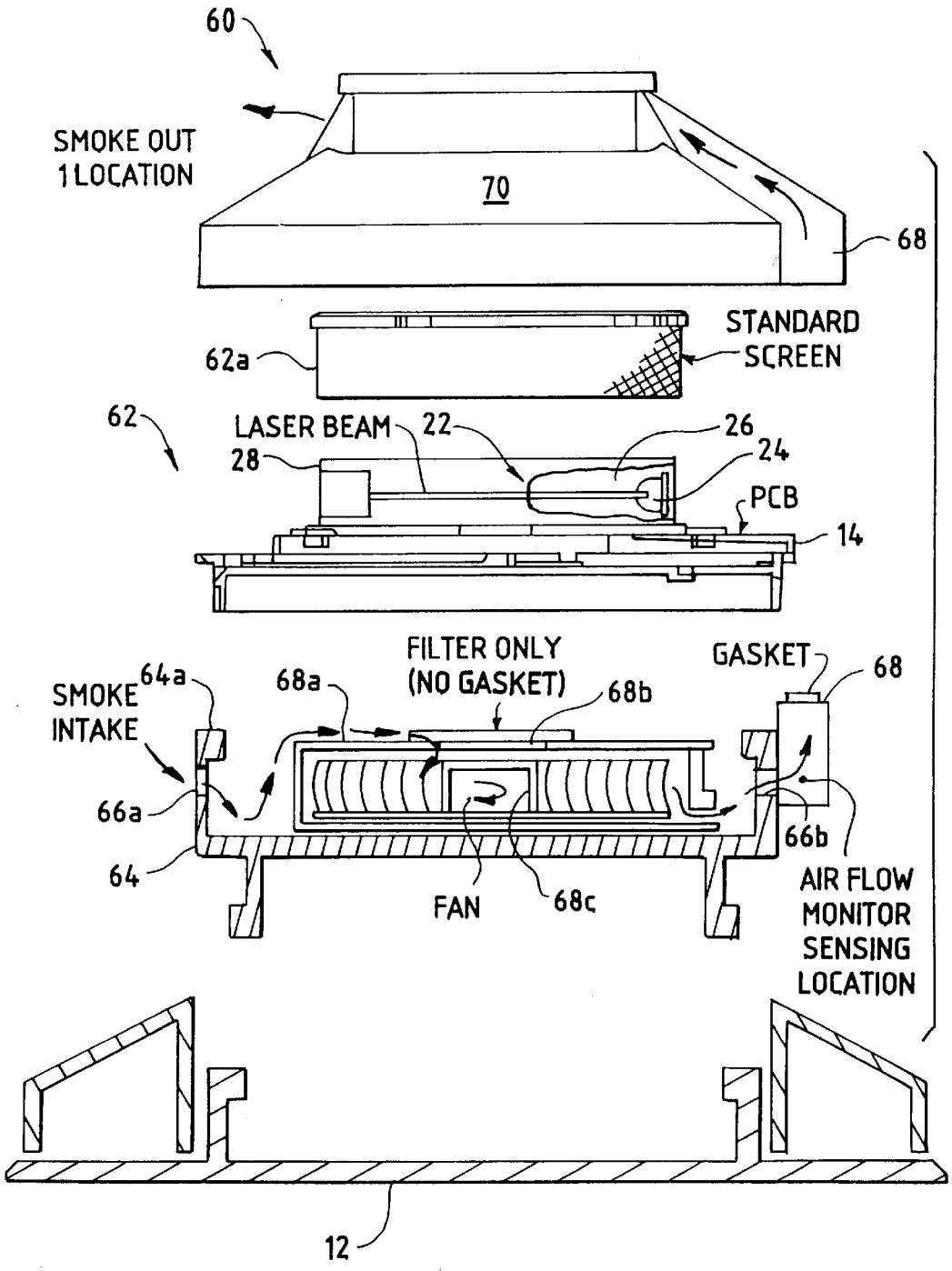
FIG. 3 is an exploded view, partly in section, of a detector in accordance with the present invention having a modular structure wherein ambient atmosphere is injected into a sensing chamber.
Figure 4:
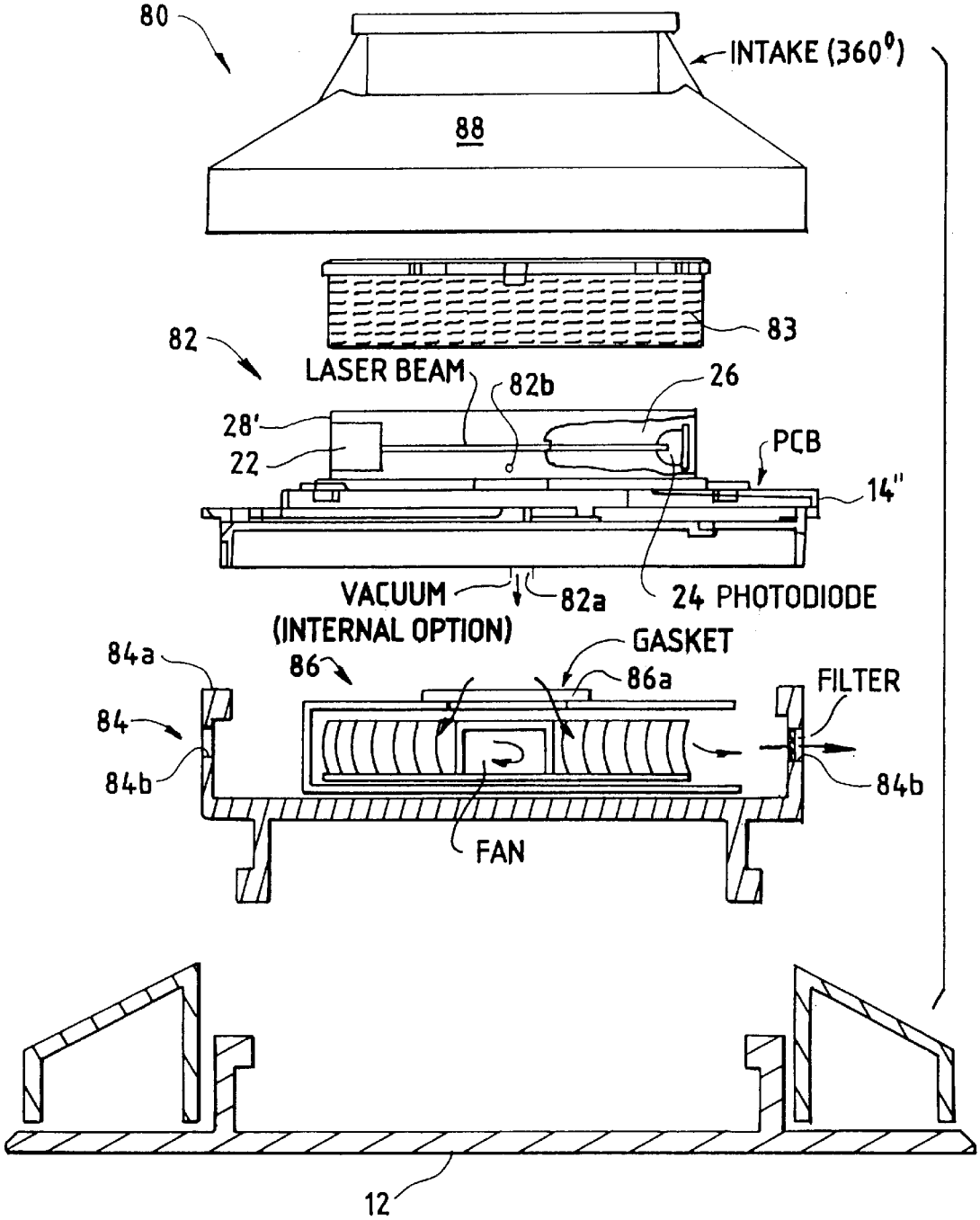
FIG. 4 is an exploded view, partly in section, of a modular detector in accordance with the present invention wherein the sensing chamber is subjected to a negative pressure.
Figure 5:
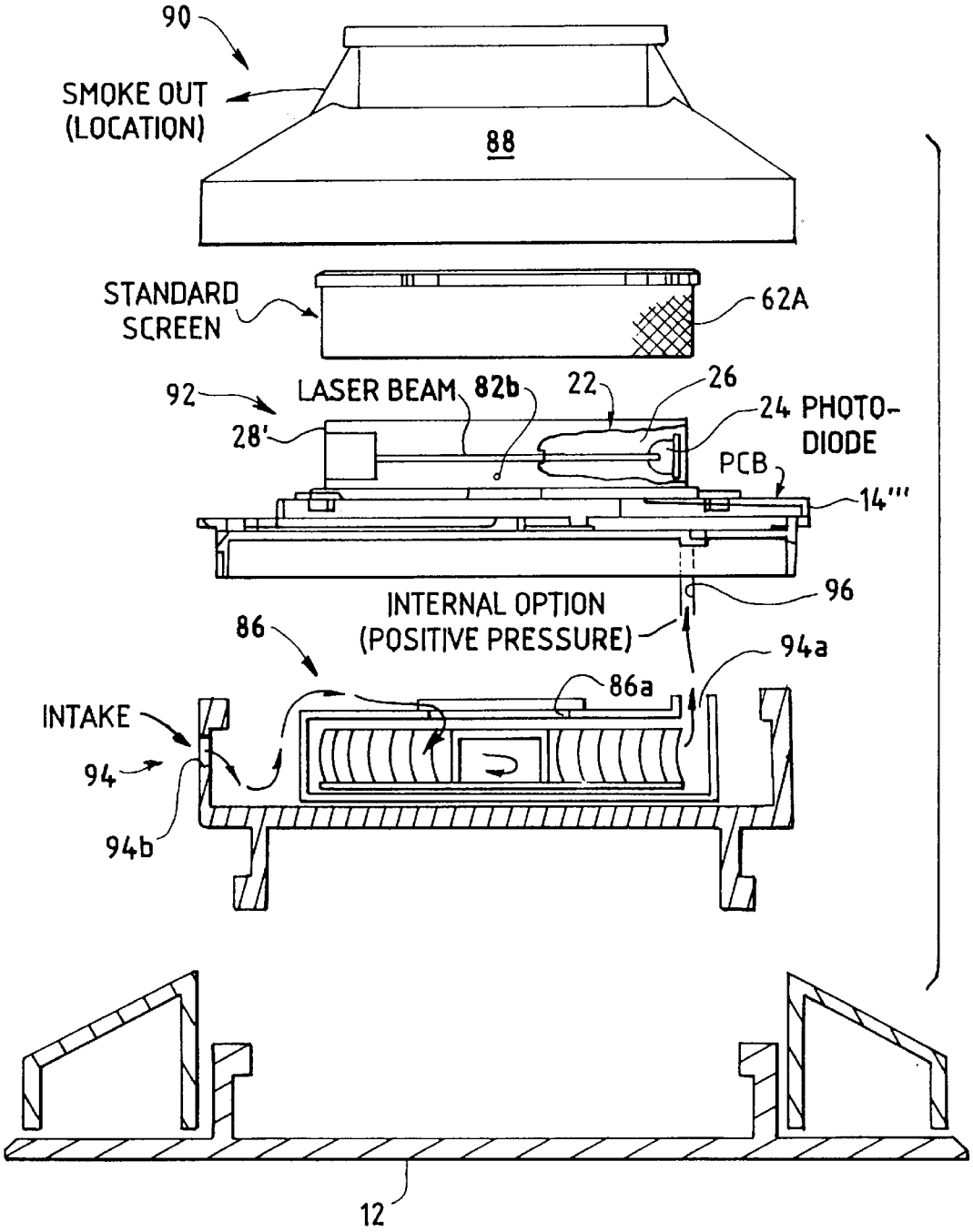
FIG. 5 is an exploded view, partly in section, of a detector in accordance with the present invention wherein a sensing chamber is pressurized.

FIGS. 3–5 illustrate photoelectric smoke detectors with modular aspiration units. These could be ionization-type smoke detectors, gas detectors or heat detectors without departing from the spirit and scope of the present invention. Similarly, the modular detectors of FIGS. 3–5 could also include control circuitry of the type discussed previously.

FIG. 3 illustrates a modular unit 60 which is configured to be usable with a known photoelectric detector 62, such as Model LPX751 marketed by System Sensor, Division of Pittway Corporation. The detector 62 includes elements similar to the elements of the photoelectric detector 10. Common elements have been given the same identification numerals and no further description of those elements is deemed to be necessary. The detector 62 is also provided with a protective screen 62*a* for purposes of excluding bugs, dust, or other undesirable particulate matter.

The unit 60 also includes a fan or blower module 64. The module 64 includes a cylindrical housing 64*a* which is designed to removably (such as with a twist-lock arrangement) engage a base element such as the base 12 as well as the detector 62. In the absence of the module 64, the detector 62 will directly, and removably engage the base 12.

The module 64 further includes one or more ambient atmospheric input ports such as 66*a* and output port 66*b*. The output port is coupled via a conduit 68 to one side of the screen 62*a* via a cover 70.

The module 64 also includes a fan or blower element, which could be a centrifugal fan 68*a*. The fan 68*a* incorporates a filtered, covered input port 68*b*, a blower or centrifugal 68*c* which rotates thereupon drawing ambient atmosphere, through the input port 66*a*, port 68*b*, and expels the ambient atmosphere through output port 66*b*.

The expelled ambient atmosphere, under positive pressure, travels through conduit 68, passes through a portion of the screen 62*a* and enters the sensing region 28 for the detector 62. The ambient atmosphere in turn exits from one side of the cover 70 after passing through region 28.

Hence, the detector 60 has the advantage that a conventional photoelectric detector, such as detector 62, can be combined with a modular fan element, such as the modular element 64, wherein the adjacent ambient atmosphere can be injected into the sensing region of the detector 62 under pressure.

FIG. 4 discloses a modular detector 80, illustrated as a photoelectric-type smoke detector, but which could also be implemented as an ionization-type smoke detector, gas detector or heat detector without limitation. The detector 80 includes photoelectric-type detector 82 having a bottom element 14" which carries light source 22, sensor 24, and optional reflector 26 so as to form a sensing region 28'.

A centrally located ambient atmospheric output port 82*a* is formed on the bottom element 14" and provides a pathway or conduit into the sensing region 28'. An airflow monitor 82*b* can also be located in the sensing region 28'. The detector 82 could also carry electronic control circuitry, not shown, such as the circuitry 20.

The detector 82 is adapted to removably engage the fan module 84, or alternately, directly engage the base 12. The fan module 84 includes a housing 84*a* and one or more ambient atmospheric output ports 84*b* (which could be covered, if desired, by a filter element). The housing 84*a* is adapted to removably engage the base 12 as well as the detector 82.

The housing 84*a* carries a fan element or centrifugal blower 86. The fan element 86 includes an ambient atmospheric, centralized, input port 86*a* which is coupled to the output port 82*a* of the detector 82. In response to rotation of the air-moving clement of the centrifugal blower 86, ambient atmosphere is drawing circumferentially through the filter 83, into the sensing region 28', out through the output port 82*a*, into the input port 86*a* and is in turn expelled through one or more output ports 84*b* of the module 84. A cover 88 encloses and protects the elements of the detector 82.

FIG. 5 illustrates an alternate aspirated detector 90 which, unlike the detector 80 which operates with a negative pressure in the sensing region, operates with a positive pressure in the sensing region. The detector 90 includes various elements which are the same as the elements of the detector 80 previously discussed. The same identification numerals have been assigned to corresponding elements of the detector 90 and further discussion of those elements is deemed to be unnecessary.

The detector 90 includes a photoelectric-type smoke sensor 92 having an internal sensing region 28' and which is carried on a bottom element 14'''. The bottom element 14''' includes an input airflow port 96 which is in turn coupled to an ambient atmospheric output port 94*a* of a fan module 94.

The detector 92 is adapted to removably engage either the fan or blower module 94 or the base 12. The fan or blower module 94 is in turn adapted to removably engage, on one end thereof, the base 12, and the other end thereof, a detector, such as the detector 92.

When the detector 92 and module 94 are coupled together, and the fan or blower unit 86 activated, ambient atmosphere will be drawn via one or more input ports 94*b* into input port 86*a* of the fan or centrifugal unit 86, forced via output port 94*a* and input port 96 into the sensing region 28'. The ambient atmosphere in the sensing region 28' exits circumferentially through the screen 62*a*. The cover 88 surrounds and protects the detector 92.

Figure 6:
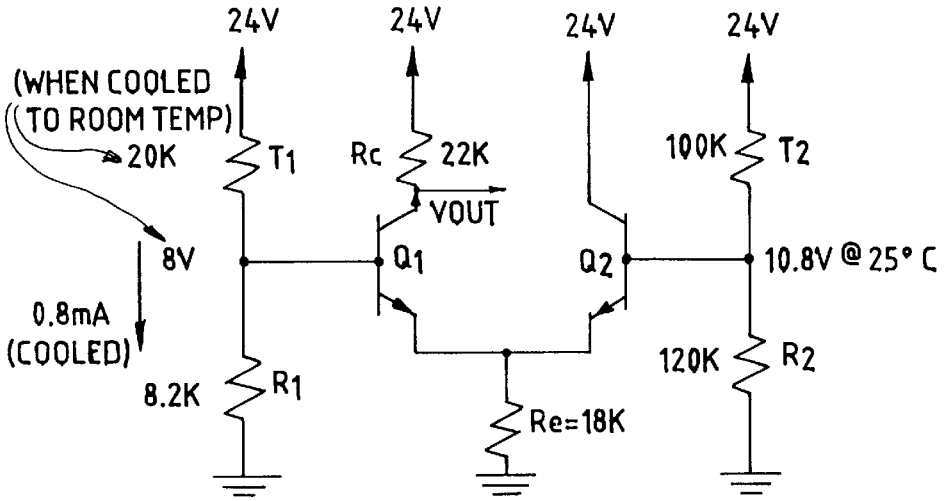
FIG. 6 is a schematic diagram of a control circuit in accordance with the present invention.

The circuit of FIG. 6 represents an active smoke entry fan supervision circuit. The circuit of FIG. 6 takes advantage of the characteristics of thermistor T1 when that thermistor is cooled to room temperature. The power being dissipated by thermistor T1. (The sensing self-heated thermistor) is about 12.8 MW. In still air, the thermistor T1 would be warmed above room temperature and as a result would be lower in resistance. This causes Q1 to conduct. When exposed to movement of ambient atmosphere due to a moving fan, such as fan 86, T1 is roughly at its higher room temperature resistance. In this condition, $V_{out}$ is 24 volts since Q1 will be cut off.

Suitable thermistors for the circuit of FIG. 6 are:

T1=Fenwall 112-2034AJ-BO1

T2=Fenwall 112-104KAJ-BO1

Figure 7:
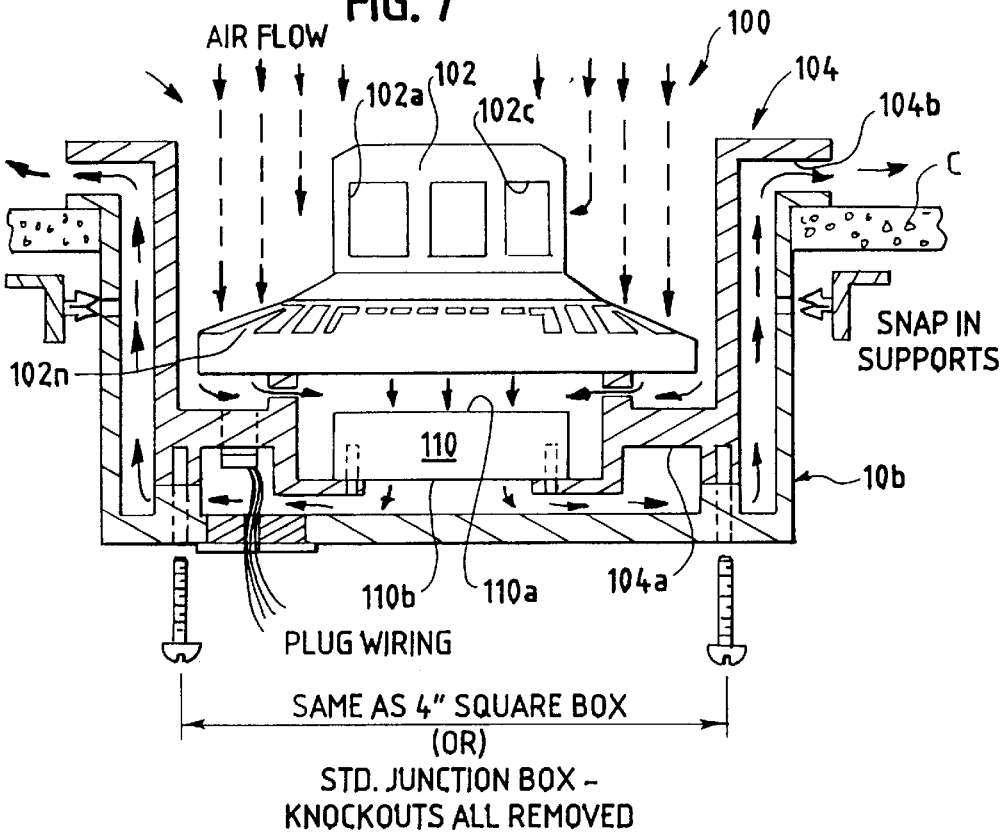
FIG. 7 is a diagram, partly in section of yet another aspirated detector.

FIG. 7 illustrates yet another form of an aspirated unit 100. The unit 100 could include a smoke detector 102. The detector 102 could for example, be a photoelectric or an ionization-type detector. Additionally, it could incorporate a gas detector if desired.

The detector 102 is carried by a mounting structure 104 which could be used either in a recessed arrangement, with a box-like element 106 or could be surface mounted directly on a ceiling or wall, such as the ceiling C. The mounting element 104, in addition to carrying the detector 102, carries an aspirating unit, or fan, 110.

The fan 110 places the sensing region of the detector 102 under a negative pressure by drawing ambient air through a plurality of openings 102*a* . . . 102*n*. The ambient atmosphere flows out of the sensing region, into the fan 110, at input port 110*a*. The ambient atmosphere is expelled by the fan 110 via output port, or ports 110*b*. The expelled ambient atmosphere flows from the output port 110*b* via flow path 104*a* to output port or region 104*b* whereat it is expelled at a direction away from the detector 102.

The detector 102 could, for example, be one of a plurality of standard detector configurations, such as smoke, thermal or gas detectors. Those detectors could be selectively mounted on the elements 104 depending on the environmental condition being sensed.

Figure 8:
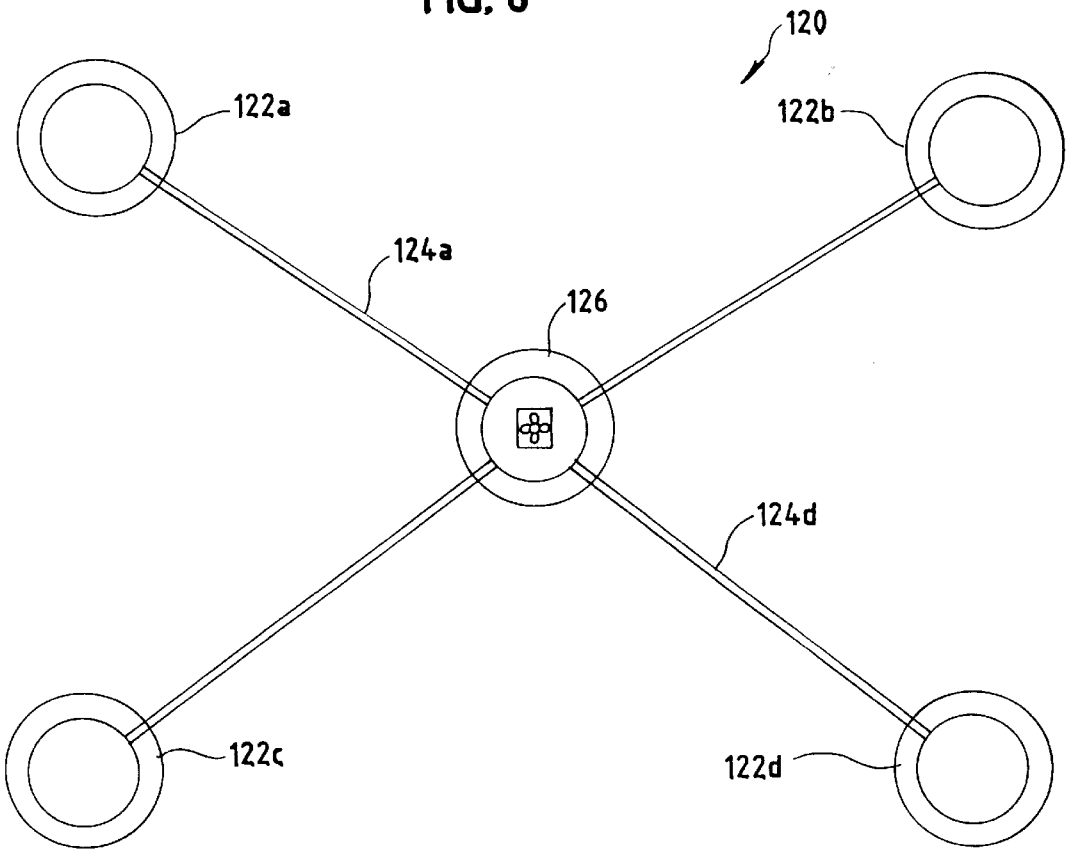
FIG. 8 is a diagram of a multiple sensor aspirated detector.

FIG. 8 illustrates an aspirated system 120 which embodies the present invention. The system 120 incorporates a plurality of spaced apart detectors 122*a* . . . 122*d*. The members of the plurality of detectors 122 are coupled via respective fluid flow tubes 124*a* . . . 124*d* to a common aspiration unit, which could be implemented as a fan 126.

The system also incorporates an aspirated detector, such as discussed above. (It can also include just an aspirating fan).

The aspiration unit 126 can be operated so as to provide a reduced pressure at each of the detectors 122*a* . . . 122*d*. The aspiration 126 could be physically mounted in a convenient place, such as a rack mounting. The detectors 122*a* . . . 122*d* could be installed in a region to be supervised without regard to the location of the aspiration unit 126. The conduits 124*a* . . . 124*d* can in turn be used to link the respective detectors to the aspiration unit 126.

Figure 9:
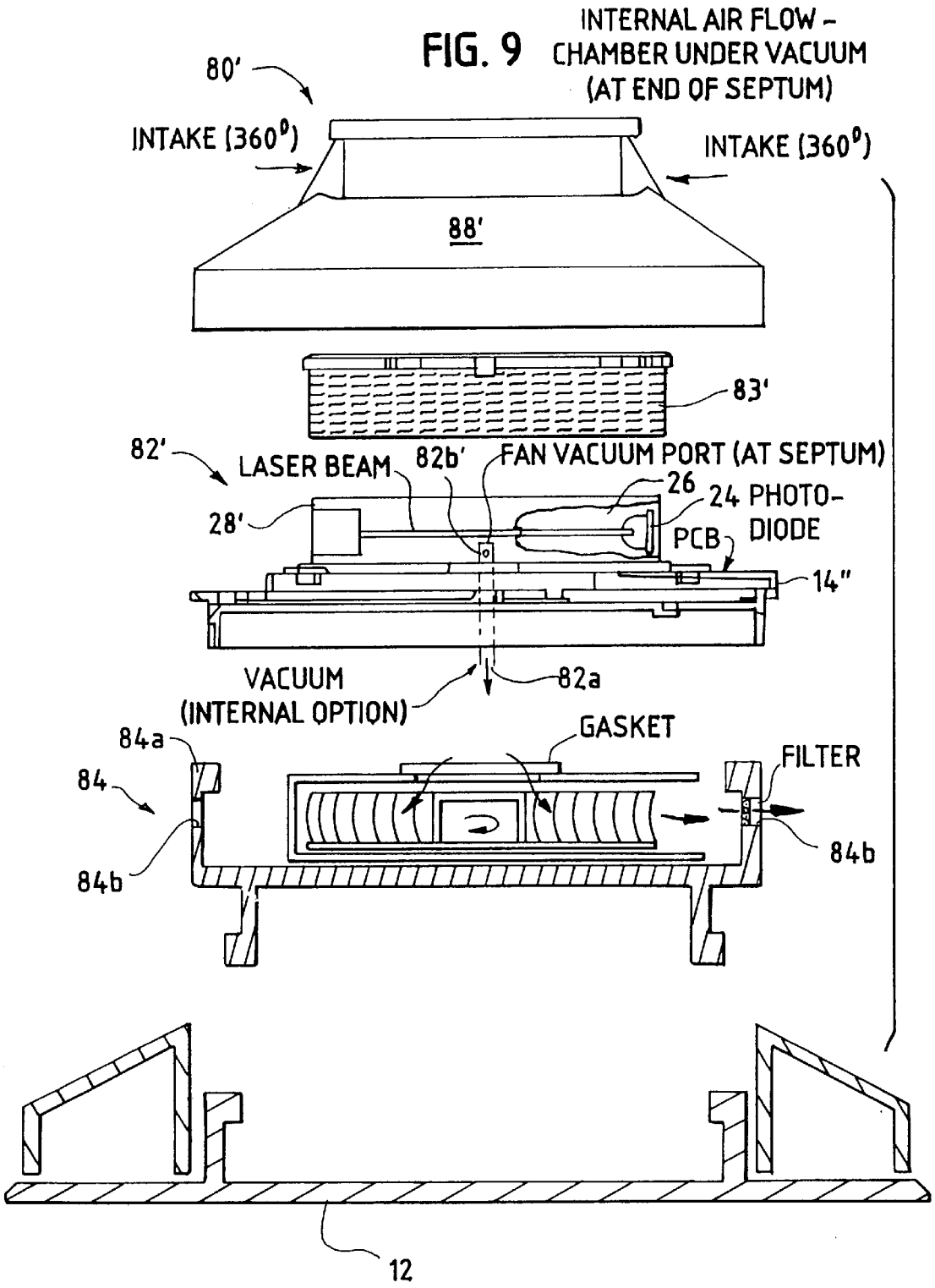
FIG. 9 is a view of yet another aspirated detector.

FIG. 9 illustrates an aspirated detector 80'. In the detector 80' a vacuum port is more or less centrally located in sensing region 28' at the end of a septum, adjacent to reflector 26.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

We claim:

1. An ambient condition aspirated detector comprising:

an exterior cover with spaces through which ambient air and airborne smoke can flow;

a circular mounting base;

a cylindrical screen displaced from the cover;

a circular side wall carried on the base wherein the side wall is enclosed by the screen, has a top that is at least substantially closed and defines an interior sensing region with circumferential flow regions, and wherein the side wall has an end closed at the base;

a source of radiant energy, and a displaced sensor located in the sensing region; and an aspirator which generates a positive pressure adjacent to the sensing region for causing ambient air and airborne smoke to flow through the screen into the sensing region wherein the aspirator is located adjacent to the top, with the sensing region located between the base and the aspirator in a stacked relationship wherein a single line centrally located relative to the screen, extends perpendicular to the base and passes through the sensing region, the top, the aspirator and the cover.

2. The detector as in claim 1 wherein the source comprises a laser diode.

3. The detector as in claim 2 which includes an elongated reflector located adjacent to the sensor.

4. The detector as in claim 1 which includes a monitor adjacent to the sensing region for detecting flow to the sensing region.

5. The detector as in claim 1 wherein at least the screen and the circular side wall share a common center line.

6. The detector as in claim 5 wherein the aspirator also shares the common center line.

* * * * *